United States Patent [19]

Kato et al.

[11] Patent Number: 4,564,252

[45] Date of Patent: Jan. 14, 1986

[54] ELECTRICAL CONNECTOR ASSEMBLY

[75] Inventors: Shinichi Kato, Atsugi; Takeshi Tamura, Takasaki; Tsugio Ambo, Tokorozawa; Katsuji Shimazawa, Tanashi, all of Japan

[73] Assignees: Nissan Motor Co., Ltd., Yokohama; Japan Electronic Control Systems Co., Ltd., Isesaki; Shinagawa Jidosha Densen Co., Ltd., Tokyo, all of Japan

[21] Appl. No.: 658,277

[22] Filed: Oct. 5, 1984

[30] Foreign Application Priority Data

Oct. 7, 1983 [JP] Japan ..... 58-187854

[51] Int. Cl.[4] ..... H01R 13/639

[52] U.S. Cl. ..... 339/91 R

[58] Field of Search ..... 339/91 R; 220/326; 285/319

[56] References Cited

U.S. PATENT DOCUMENTS

| | | | |
|---|---|---|---|
| 1,835,251 | 12/1931 | Wetstein | 339/91 R |
| 1,899,360 | 2/1933 | Roudebush et al. | 339/91 R |
| 2,194,769 | 3/1940 | Reed | 339/91 R |
| 2,235,020 | 3/1941 | Jones | 339/91 R |
| 3,188,600 | 6/1965 | Woofter et al. | 339/91 R |
| 3,544,951 | 12/1970 | Roberts | 339/91 R |
| 4,443,048 | 4/1984 | Moist, Jr. | 339/217 S |

*Primary Examiner*—John McQuade

*Attorney, Agent, or Firm*—Schwartz, Jeffery, Schwaab, Mack, Blumenthal & Evans

[57] ABSTRACT

Herein disclosed is a heat resisting electrical connector assembly which has a heat resisting metallic locking clip. The locking clip is detachably fixed to a female part of the connector assembly and comprises a first portion lockably fixed to the female part, a second portion having a locking opening formed therein and a third portion having a free end, the third portion being resiliently moved together with the free end thereof toward the first portion when pressed toward the first portion. A male part of the connector assembly is formed with a projection with which the locking opening of the clip is engaged upon final coupling of the male and female parts. A fulcrum structure is formed on the female part to support partially the third portion of the clip in such a manner that when the third portion is pressed toward the first portion, the second portion is raised away from the first portion thereby disengaging the locking opening of the clip from the projection.

11 Claims, 7 Drawing Figures

ELECTRICAL CONNECTOR ASSEMBLY

BACKGROUND OF THE INVENTION (1) Field of the Invention

The present invention relates to an electrical connector assembly and more particularly to an electrical connector assembly comprising a male part and a female part which are lockably connectable together.

(2) Description of the Prior Art

Hitherto, various kinds of electrical connector assemblies have been proposed for the purpose of providing electrical connection between two electric devices. Some of the connector assemblies are of a type which comprises a plastic male part and a plastic female part which are lockably connectable together by locking means included in each of the parts. Most of the locking means comprise a latch-like member integral with one part and a striker-like member integral with the other part. However, due to the nature of the plastics, the locking function provided by such locking means deteriorates with the lapse of time. This undesirable phenomenon is pronounced in high temperature environments, sometimes leading to unexpected uncoupling of them during usage of same.

SUMMARY OF THE INVENTION

It is thus an object of the present invention to provide an electrical connector assembly which can endure a high temperature environment.

It is another object of the present invention to provide an electrical connector assembly which comprises heat-resisting metallic locking clips for locking the male and female parts thereof together.

It is still another object of the present invention to provide an electrical connector assembly comprising male and female parts which can be assuredly coupled and easily uncoupled.

According to the present invention, there is provided, in an electrical connector assembly comprising first and second matable parts which are respectively provided with first and second groups of terminal elements which are sufficiently mated with one another upon final coupling of the first and second parts, improved locking means for locking the first and second parts when they are finally coupled together. The locking means comprises a locking clip made of resilient metal detachably fixed to the first part, the clip including a first portion lockably fixed to the first part, a second portion having a locking opening formed therein and a third portion having a free end, the third portion being resiliently moved together with the free end thereof toward the first portion when pressed toward the first portion, a projection formed on the second part, the projection being thrusted into the locking opening of the locking clip when the first and second parts are finally coupled, and fulcrum means formed on the first part to support partially the third portion of the clip in such a manner that when the third portion is depressed toward the first portion, the second portion is raised away from the first portion thereby disengaging the locking opening of the clip from the projection of the second part.

BRIEF DESCRIPTION OF THE DRAWINGS

Other objects and advantages of the present invention will be apparent from the following description when taken in conjunction with the accompanying drawings, in which.

DETAILED DESCRIPTION OF THE INVENTION

Referring to FIGS. 1 to 6, there is shown an electrical connector assembly according to the present invention. As is seen from FIG. 1, the electrical connector assembly comprises generally a pair of matable connector parts, which are a female part 10 and a male part 12. As will become clear as the description proceeds, upon fully mated coupling therebetween, locking means provided on each part is cooperated to latch the parts together.

Figure 1:
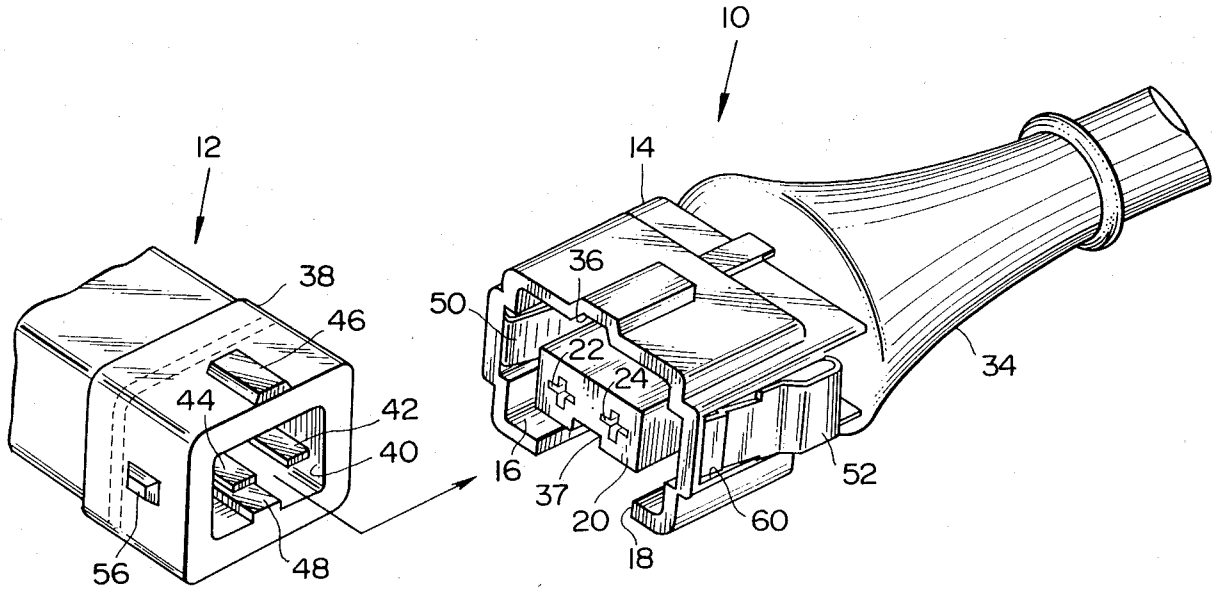
FIG. 1 is a perspective view of an electrical connector assembly according to the present invention, showing male and female parts in separated condition.

The female part 10 comprises a housing 14 of molded insulating material, such as glassfiber-reinforced nylon. The housing 14 has a cavity 16 therein and a slot 18 in the lower wall thereof. A column 20 is spacedly arranged in the cavity 16, which extends axially from the bottom of the cavity 16 toward the mouth of the same, as is understood from FIG. 1. The column 20 is formed with two axially extending bores 22 and 24 in which contact socket terminals 26 and 28 (see FIG. 2) are snugly received respectively. The terminals 26 and 28 are secured to wires 30 and 32 which extend rearwardly from the housing 14, as shown. As is shown in FIG. 1, an insulating cover 34 is fixed to the rear half of the female part 10 to cover the wires 30 and 32. For this fixing, the rear end of the housing 14 is axially elongated somewhat, terminating with an enlarged tapered portion 35, as is seen from FIGS. 2 and 3. With the enlarged portion 35, the cover 34 is tightly fixed to the housing 14 of the female part 10. For the purpose which will be described hereinafter, the upper wall of the housing 14 is formed with an internal groove 36 which extends axially from the mouth of the housing 14 toward the rear end of the same, as is seen in FIG. 1. Furthermore, the column 20 is also formed with an axially extending groove 37 at its lower surface.

The male part 12 comprises a housing 38 which is constructed of the same material as the housing 14 of the female part 10. The housing 38 of the male part 12 is so sized and constructed as to be snugly received in the cavity 16 of the female part 10. The housing 38 of the male part 12 has therein an axially extending cavity 40 which is sized and constructed to snugly receive therein the column 20 of the female part 10. Two contact plug terminals 42 and 44 are spacedly arranged in the cavity 40, which terminals extend axially from the bottom of the cavity 40 toward the mouth of the same, as is understood from FIG. 1. Upon proper coupling of the male and female parts 12 and 10, the plug terminals 42 and 44 of the male part 12 are respectively mated with the socket terminals 26 and 28 of the female part 10 to provide electric connection therebetween, as is understood from FIG. 3. The upper surface of the housing 38 and the lower surface of the cavity 40 are respectively formed with axially extending ridges 46 and 48 which, upon coupling of the male and female parts 12 and 10, are slidably received in the afore-mentioned grooves 36 and 37 of the female part 10 to assure proper coupling. Although not shown in the drawings, wires are connected to the plug terminals 42 and 44, which extend rearwardly from the housing 38 of the male parts 12.

Locking means is provided on each part 10 or 12, which functions to lock or latch the male and female parts 12 and 10. The locking means comprises generally two locking clips 50 and 52 of metal detachably fixed to the housing 14 of the female part 10, and two projections 54 and 56 integrally formed on the housing 38 of the male part 12, which are lockably engageable respectively in the manner as will be described hereinafter.

In order to receive therein the locking clips 50 and 52, the lateral sides of the housing 14 of the female part 10 are respectively formed with rectangular recesses 58 and 60 each being bounded by two axially extending parallel banks (no numerals) and a front bank (no numeral) which is perpendicular to the parallel banks. As is understood from FIG. 2 or 3, the bottom portion of each recess 58 or 60 is formed with a considerable opening merged with the cavity 16 of the housing 14, leaving a rear portion 62 or 64 thereof. The rear portion 62 or 64 is integrally formed with a boss 62*a* or 64*a* which is projected outwardly. The boss 62*a* or 64*a* has an inclined surface with a forwardly facing shoulder portion, as shown. As may be understood from FIGS. 2 and 6, the axially extending parallel banks of each recess 58 or 60 are respectively formed at the inside surface thereof with generally rectangular platforms 66 and 68 or 70 and 72, which serve as fulcrum means for the associated locking clip 50 or 52, as will be clear as the description proceeds.

The two locking clips 50 and 52 have the same constructions, and thus only one clip 50 will be described in detail in the following in order to facilitate the description. Portions of the other clip 52 are indicated by the addition of the same letters (a, b, c . . . k) after the numeral 52 in the drawings.

Figure 4:
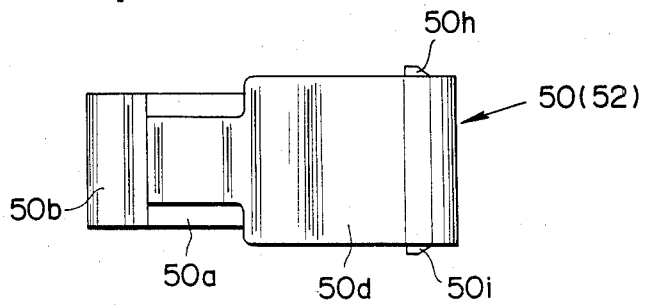
FIG. 4 is a plan view of a locking clip employed in the present invention.
Figure 5:
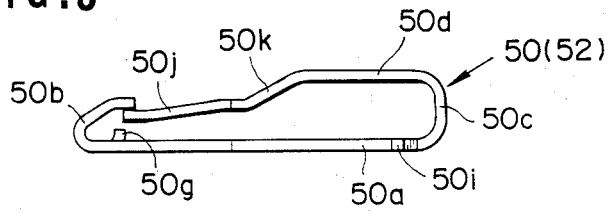
FIG. 5 is a side view of the locking clip of FIG. 4.
Figure 6:
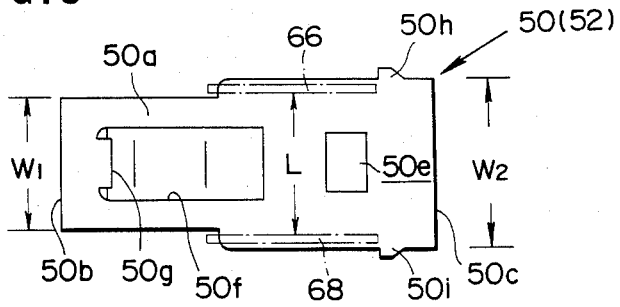
FIG. 6 is a bottom view of the locking clip of FIG. 4.

Referring to FIGS. 4 to 6, there is shown the clip 50 which is of a stamped or press-formed monoblock heat resisting resilient metallic member and comprises generally a rectangular base portion 50*a*, a front curved portion 50*b*, a rear curved portion 50*c* and an upper depressable portion 50*d* which are combined to define substantially a "hair-pin" shaped cross section, as is understood from FIG. 5. As is seen in FIG. 6, the base portion 50*a* is formed at its rear portion with a smaller rectangular opening 50*e* and at its front portion with a larger rectangular opening 50*f*. The opening 50*f* is sized to match with the projection 54 on the male part housing 38. The front edge of the larger opening 50*f* is raised upwardly to provide a curved boss 50*g* as is best seen in FIG. 5. As is seen FIG. 6, the rear half of the base portion 50*a* is somewhat enlarged. The front half is so sized as to have a desirable resiliency. The enlarged portion is formed at the rear portions thereof with lateral bosses 50*h* and 50*i* each having an inclined surface with a forwardly facing shoulder portion. The front curved portion 50*b* has the same width as the base portion 50*a* and extends from the same turning rearward, as is seen from FIG. 5. The rear curved portion 50*c* extends from the enlarged rear end of the base portion 50*a* and curves forward to be merged with the upper depressable portion 50*d*. The front half 50*j* of the upper portion 50*d* is reduced in width and bent downwardly at 50*k*. The leading end or free end of the upper portion 50*d* is located beneath the leading end of the front ourved portion 50*b*. Thus, it will be appreciated that upon depression of the upper portion 50*d* toward the base portion 50*a*, the free end of the upper portion 50*d* moves toward the base portion 50*a* while disengaging from the leading end of the front curved portion 50*b*. As may be understood from FIG. 6, the width $W_1$ of the front half of the base portion 50*a* (and thus, of the front curved portion 50*b*) is smaller than the distance L between the paired platforms 66 and 68 formed on the parallel banks of the recess 58, while, the width $W_2$ of the enlarged rear half of the base portion 50*a* is greater than the distance L. For assembly, the clip 50 is slidably inserted from the rear non-banked portion of the recess 58 and then moved forwardly (that is, leftwardly in FIG. 2) until the boss 62*a* of the female part housing 14 is lockably engaged with the smaller opening 50*e* of the clip 50. With the inclined surface of the boss 62*a*, the insertion of the clip 50 to the locked position is smoothly achieved. In this locked condition, the front half 50*j* of the upper portion 50*d* is partially seated on the parallel platforms 66 and 68 as is understood from FIG. 2, and the laterally projected bosses 50*h* and 50*i* of the clip 50 abut on the rear ends of the parallel banks of the recess 58 of the housing 14 as may be understood from the same drawing.

Figure 2:
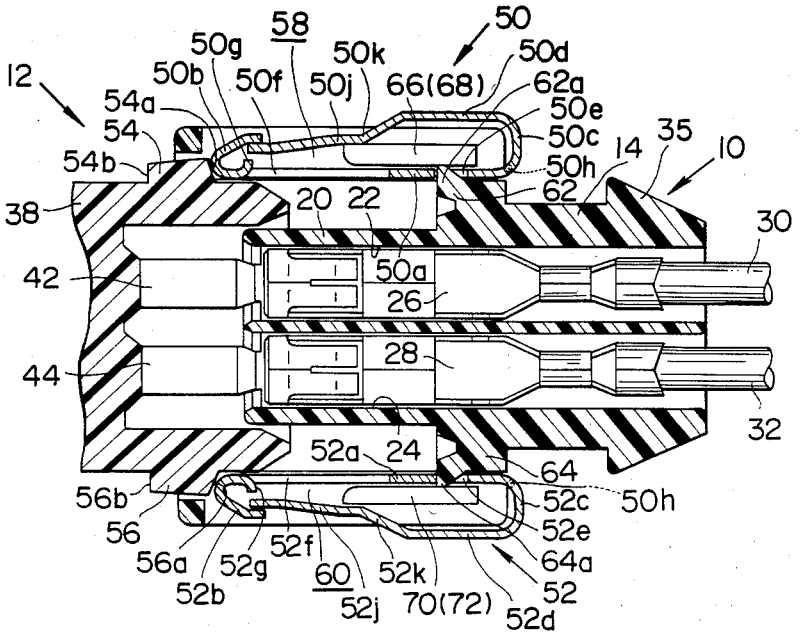
FIG. 2 is a sectional view of the electrical connector assembly, showing the two parts in half-mated condition.
Figure 3:
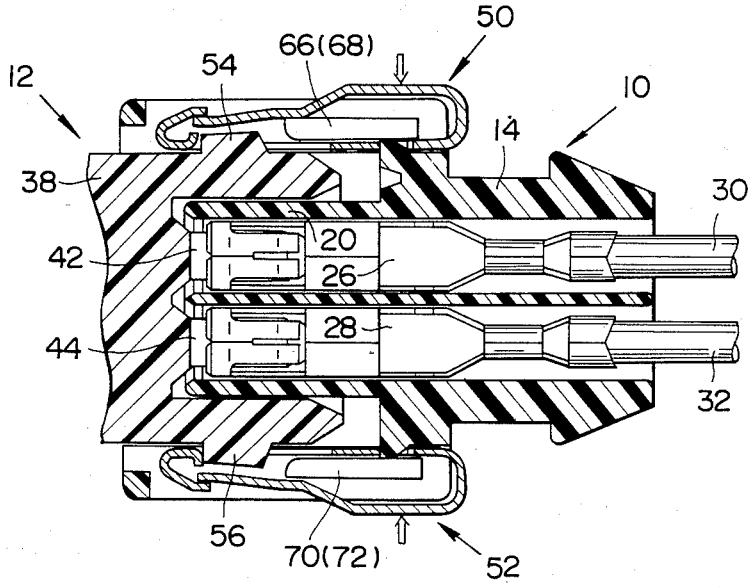
FIG. 3 is a view similar to FIG. 2, but showing the two in full-mated condition.

As is seen from FIG. 2, each projection 54 or 56 on the male part housing 38 comprises an inclined surface 54*a* or 56*a* having a rearwardly facing shoulder portion 54*b* or 56*b*.

When coupling of the male and female parts 12 and 10 is required, the male part 12 is put into the mouth of the cavity 16 of the female part 10 with the axially extending ridges 46 and 48 thereof slidably received in the grooves 36 and 37 of the female part 10, respectively. This condition is depicted by FIG. 2. Then, the male part 12 is thrusted deeply into the cavity 16 of the female part 10 until the plug terminals 42 and 44 of the male part 12 are sufficiently mated with the associated socket terminals 26 and 28 of the female part 10. During this movement, the front curved portions 50*b* and 52*b* of the locking clips 50 and 52 of the female part 10 ride over the projections 54 and 56 of the male part 12 against the spring force thereof and finally induce instant thrust of the projections 54 and 56 into the openings 50*f* and 52*f* of the clips 50 and 52. With this, the two parts 12 and 10 are locked together, as is seen from FIG. 3. The provision of the inclined surfaces 54*a* and 56*a* of the projections 54 and 56 of the male part 12 facilitates the riding over action of front curved portions 50*b* and 52*b* of the clips 50 and 52.

When uncoupling of the parts 12 and 10 is required, the outwardly expanded sections of the upper portions 50*d* and 52*d* of the clips 50 and 52 are depressed toward the female part proper 10. With this, the front halves 50*j* and 52*j* of the upper portions 50*d* and 52*d* are lifted (that is, moved away from the female part proper 10) using the platforms 66 and 68, 70 and 72 as their fulcrums, thereby lifting the front curved portions 50*b* and 52*b* of the clips 50 and 52 away from the associated projections 54 and 56 of the male part 12. Thus, uncoupling of the parts 12 and 10 is easily achieved by pulling them away while pressing the clips 50 and 52 inwardly. It is to be noted that the provision of the curved bosses 50*g* and 52*g* of the clips 50 and 52 avoids undesirable entanglement between the clips 50 and 52 and the projections 54 and 56 at the time of the uncoupling.

Figure 7:
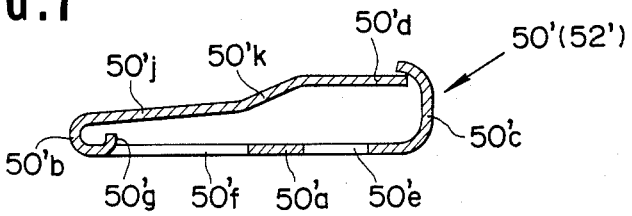
FIG. 7 is a sectional view of a modified locking clip employable in the present invention.

Referring to FIG. 7, there is shown, in a sectional manner, a modified locking clip 50' (or 52') usable in the invention. In this modification, the free end of the upper depressable portion 50'*d* is positioned at the rear curved portion 50'*c*. Similar to the afore-mentioned clip 50, depression of the outwardly expanded section of the upper portion 50'*d* will raise the front curved portion 50'*b* by using parallel platforms 66 and 68 as the fulcrum means.

Various other modifications may be made to those skilled in the art without departing from the scope of the invention. For example, the locking clips 50 and 52 may be fixed to the male part 12, and the locking projections 54 and 56 may be formed on the female part 10.

What is claimed is:

1. In an electrical connector assembly comprising first and second matable parts which are respectively provided with first and second groups of terminal elements which are sufficiently mated with one another upon final coupling of said first and second parts, locking means for locking said first and second parts when they are finally coupled together, said locking means comprising:

a locking clip made of resilient metal detachably fixed to said first part, said clip including a first portion lockably fixed to said first part, a second portion having a locking opening formed therein and a third portion having a free end which is in contact with one of said portions such that said clip is in the form of a loop, said third portion being resiliently moved together with the free end thereof toward said first portion when pressed toward said first portion;

a projection formed on said second part, said projection being thrusted into said locking opening of said locking clip when said first and second parts are finally coupled; and fulcrum means formed on said first part to support partially said third portion of said clip in such a manner that when said third portion is pressed toward said first portion, said second portion is raised away from said first portion thereby disengaging said locking opening of said second portion from said projection.

2. In an electrical connector assembly comprising first and second matable parts which are respectively provided with first and second groups of terminal elements which are sufficiently mated with one another upon final coupling of said first and second parts, locking means for locking said first and second parts when they are finally coupled together, said locking means comprising:

a locking clip made of resilient metal detachably fixed to said first part, said clip including a first portion lockably fixed to said first part, a second portion having a locking opening formed therein and a third portion having a free end, said third portion being resiliently moved together with the free end thereof toward said first portion when pressed toward said first portion;

a projection formed on said second part, said projection being thrusted into said locking opeining of said locking clip when said first and second parts are finally coupled; and fulcrum means formed on said first part to support partially said third portion of said clip in such a manner that when said third portion is pressed toward said first portion, said second portion is raised away from said first portion thereby disengaging said locking opening of said second portion from said projection;

wherein said free end of said third portion of said clip is in contact with said second portion, so that when said third portion is pressed, the free end of said third portion is raised to lift said second portion away from said first portion.

3. Locking means as claimed in claim 1, in which said free end of said clip is located away from said second portion, so that when said third portion is pressed, the free end is moved toward said first portion while raising said second portion.

4. Locking means as claimed in claim 1, in which said first portion is formed with a rectangular opening into which a boss formed on said first part is thrusted to achieve locking connection between said clip and said first part.

5. Locking means as claimed in claim 4, in which said boss comprises an inclined surface having a forward facing shoulder portion.

6. Locking means as claimed in claim 5, in which said first portion of the clip is formed with lateral bosses which abut on a portion of said first part to suppress excessive movement of said clip in one direction relative to said first part.

7. In an electrical connector assembly comprising first and second matable parts which are respectively provided with first and second groups of terminal elements which are sufficiently mated with one another upon final coupling of said first and second parts, locking means for locking said first and second parts when they are finally coupled together, said locking means comprising:

a locking clip made of resilient metal detachably fixed to said first part, said clip including a first portion lockably fixed to said first part, a second portion having a locking opening formed therein and a third portion having a free end, said third portion being resiliently moved together with the free end thereof toward said first portion when pressed toward said first portion;

a projection formed on said second part, said projection being thrusted into said locking opening of said locking clip when said first and second parts are finally coupled; and fulcrum means formed on said first part to support partially said third portion of said clip in such a manner that when said third portion is pressed toward said first portion, said second portion is raised away from said first portion thereby disengaging said locking opening of said second portion from said projection;

wherein said first portion is formed with a rectangular opening into which a boss formed on said first part is thrusted to achieve locking connection between said clip and said first part;

wherein said boss comprises an inclined surface having a forward facing shoulder portion;

wherein said first portion of the clip is formed with lateral bosses which abut on a portion of said first part to suppress excessive movement of said clip in one direction relative to said first part; and wherein a front edge of said locking opening of said clip is raised to form a curved boss.

8. Locking means as claimed in claim 7, in which said first portion of the clip comprises a front half section and a rear half section, the width of said rear half section being greater than that of said front half section.

9. Locking means as claimed in claim 8, in which said fulcrum means comprises a pair of platforms which are respectively formed on the inward surfaces of facing parallel banks formed on said first part, the distance between the paired platforms being greater than the width of the front half section of said first portion of the clip but smaller than that of said rear half section of the same.

10. Locking means as claimed in claim 9, in which said parallel banks define a rectangular recess formed in said first part, into which said recess said locking clip is snugly received.

11. Locking means as claimed in claim 1, in which said projection comprises an inclined surface having a rearwardly facing shoulder portion.

* * * * *